US006578540B2

(12) United States Patent
Kawamoto

(10) Patent No.: US 6,578,540 B2
(45) Date of Patent: Jun. 17, 2003

(54) CAM SHAFT POSITIONING STRUCTURE OF ENGINE

(75) Inventor: Yuichi Kawamoto, Akashi (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 10/107,642

(22) Filed: Mar. 27, 2002

(65) Prior Publication Data

US 2002/0139343 A1 Oct. 3, 2002

(30) Foreign Application Priority Data

Mar. 27, 2001 (JP) ..... 2001-090702

(51) Int. Cl.[7] ..... F01L 1/053; F01L 1/04
(52) U.S. Cl. ..... 123/193.5; 123/90.27
(58) Field of Search ..... 123/193.5, 90.27

(56) References Cited

U.S. PATENT DOCUMENTS 4,593,657 A * 6/1986 Aoi et al. ..... 123/90.27
5,651,337 A * 7/1997 Regueiro ..... 123/90.27
6,305,242 B1 * 10/2001 Smith et al. ..... 123/90.27
6,523,518 B2 * 2/2003 Kunde et al. ..... 123/193.5

* cited by examiner

*Primary Examiner*—Marguerite McMahon
(74) *Attorney, Agent, or Firm*—Marshall, Gerstein & Borun

(57) ABSTRACT

Disclosed is a cam shaft positioning structure of an engine. In the cam shaft positioning structure, a groove 51 is provided in a rocker case 50, for accommodating a flange portion 31 of the cam shaft 20. In the state in which the rocker case 50 is not mounted on the cylinder head 40, the cam shaft 20 is axially displaceable with respect to the cylinder head 40 from a normal position. In the state in which the cam shaft 20 is securely retained between the cylinder head 40 and the rocker case 50, the axial displacement of the flange portion 31 is restricted by the groove 51. Therefore, the cam shaft 20 is axially positioned with respect to the cylinder head 40 so as to be placed at the normal position.

3 Claims, 8 Drawing Sheets

Prior Art

CAM SHAFT POSITIONING STRUCTURE OF ENGINE

BACKGROUND OF THE INVENTION

1. Field of the Invention

The present invention relates to a structure for positioning a cam shaft on a cylinder head of an engine.

2. Description of the Related Art

In some engine employed in an automobile, a motorcycle, a small ATV (small all terrain vehicle), a snow mobile, a small leisure vehicle, a personal watercraft, or the like, a single cam shaft is mounted on a cylinder head. The cam shaft serves to operate an intake/exhaust valve of the engine by means of a rocker arm and is positioned so that a cam face thereof is at a proper position with respect to the rocker arm.

FIG. 8 is a view showing the conventional cam shaft positioning structure and a longitudinal sectional view of a cylinder head 140 on which a rocker case 150 is mounted. A cam shaft 120 is provided with a flange portion 131. The flange portion 131 is axially positioned by a groove 149 formed in the cylinder head 140. The width (axial dimension) of the groove 149 is slightly larger than the thickness (axial dimension) of the flange portion 131. Therefore, the flange portion 131 is substantially undisplaceable in the axial direction because of restriction of the groove 149. Thus, the cam shaft 120 is axially positioned with respect to the cylinder head 140 so as to be placed at a normal position.

The rocker case 150 is fixed on the cylinder head 140. The structure for axially positioning the cam shaft 120 is not provided in the rocker case 150. For example, a groove 159 is formed in the rocker case 150 and the width (axial dimension) thereof is considerably larger than the thickness of the flange portion 131. Therefore, the flange portion 131 is not in contact with an inner wall face of the groove 159.

However, in the cam shaft positioning structure of FIG. 8, a procedure for placing the cam shaft 120 on the cylinder head 140 and then mounting the rocker case 150 on the cylinder head 140 takes long time and impedes an assembly process of the engine.

In this procedure, before the rocker case 150 is mounted on the cylinder head 140, the cam shaft 120 is placed on the cylinder head 140. At this time, the flange portion 131 of the cam shaft 120 is fitted into the groove 149 of the cylinder head 140. At this stage, a cam sprocket 115 is not mounted to the cam shaft 120 yet.

Subsequently, with a chain 163 put around the cam sprocket 115, the cam sprocket 115 is mounted to the cam shaft 120. The cam sprocket 115 is secured to the cam shaft 120 by means of two bolts.

Then, the rocker case 150 provided with a rocker arm is mounted on the cylinder head 140. Thereby, the mounting of the cam shaft 120 is completed.

In the above-described procedure, the operation in which the chain 163 is put around the cam sprocket 115 which is then secured to the cam shaft 120 by means of the bolts makes the inefficient assembly and therefore impedes the assembly process.

If the cam sprocket 115 is mounted to the cam shaft 120 in advance and then the chain 163 is put around the cam sprocket 115, it becomes impossible to fit the cam shaft 120 into the cylinder head 140. The reason for this is that since the thickness of the flange portion 131 is substantially equal to the width of the groove 149, and therefore, there is little play between the flange portion 131 and the groove 149, the flange portion 131 cannot be inclined with respect to the groove 149 when inserted thereinto.

SUMMARY OF THE INVENTION

The present invention addresses the above-described conditions, and an object of the present invention is to provide a cam shaft positioning structure of a single overhead cam type engine capable of providing efficient assembly.

To achieve the above-described object, according to the present invention, there is provided a cam shaft positioning structure of an engine comprising: a cylinder head provided with one part of a bearing; a rocker case provided with the other part of the bearing; and a cam shaft rotatably supported by the bearing formed by mounting the rocker case on the cylinder head, and being applied to a single over head cam type engine, wherein the cam shaft is provided with a flange portion, the rocker case is provided with a groove for accommodating the flange portion, and wherein in a first state in which the rocker case is mounted on the cylinder head and the cam shaft is securely retained between the cylinder head and the rocker case, the groove is adapted to restrict axial displacement of the flange portion to allow the cam shaft to be axially positioned with respect to the cylinder head so as to be placed at a normal position, and in a second state in which the cam shaft is placed on the cylinder head and the rocker case is not mounted on the cylinder head, the cam shaft is able to be axially displaceable with respect to the cylinder head from the normal position.

In this constitution, with the cam shaft placed on the cylinder head, the cam shaft is axially displaceable. Therefore, after mounting the cam sprocket and the like to the cam shaft, the cam shaft can be placed on the cylinder head in an inclined condition and a chain can be put around the cam sprocket in a loose condition. In addition, the axial positioning of the cam shaft can be performed by mounting the rocker case to the cylinder head later.

In the cam shaft positioning structure of an engine, it is preferable that a guide portion for guiding the flange portion into the groove is formed by cutting out the rocker case at both end portions in a circumferential direction of the groove. With this constitution, the alignment of the groove and the flange portion can be easily made by the guide portion.

It is preferable that the cam shaft positing structure of an engine, comprises: restricting means for restricting axial displacement of the cam shaft with respect to the cylinder head from the normal position so as to be within a predetermined range in the second state, wherein, in the second state, when the cam shaft is axially displaced most greatly to one side of the cylinder head, a position of one end face of the flange which is close to one side of the cylinder head is closer to the other side of the cylinder head than a first axial position, the first axial position corresponds to one end position of an entrance of the guide portion which is close to the one side of the cylinder head in the first state, in the second state, when the cam shaft is axially displaced most greatly to the other side of the cylinder head, a position of the other end face of the flange is closer to one side of the cylinder head than a second axial position, and the second axial position corresponds to the other end position of an entrance of the guide portion in the first state. With this constitution, the flange portion is guided into the groove by the guide portion regardless of whether the cam shaft is axially displaced most greatly to one side or to the other side of the cylinder head.

The above and further objects and features of the invention will more fully be apparent from the following detailed description with accompanying drawings.

DETAILED DESCRIPTION OF THE PREFERRED EMBODIMENT

Hereinafter, a cam shaft positioning structure of an engine according to an embodiment of the present invention will be described with reference to drawings.

Figure 1:
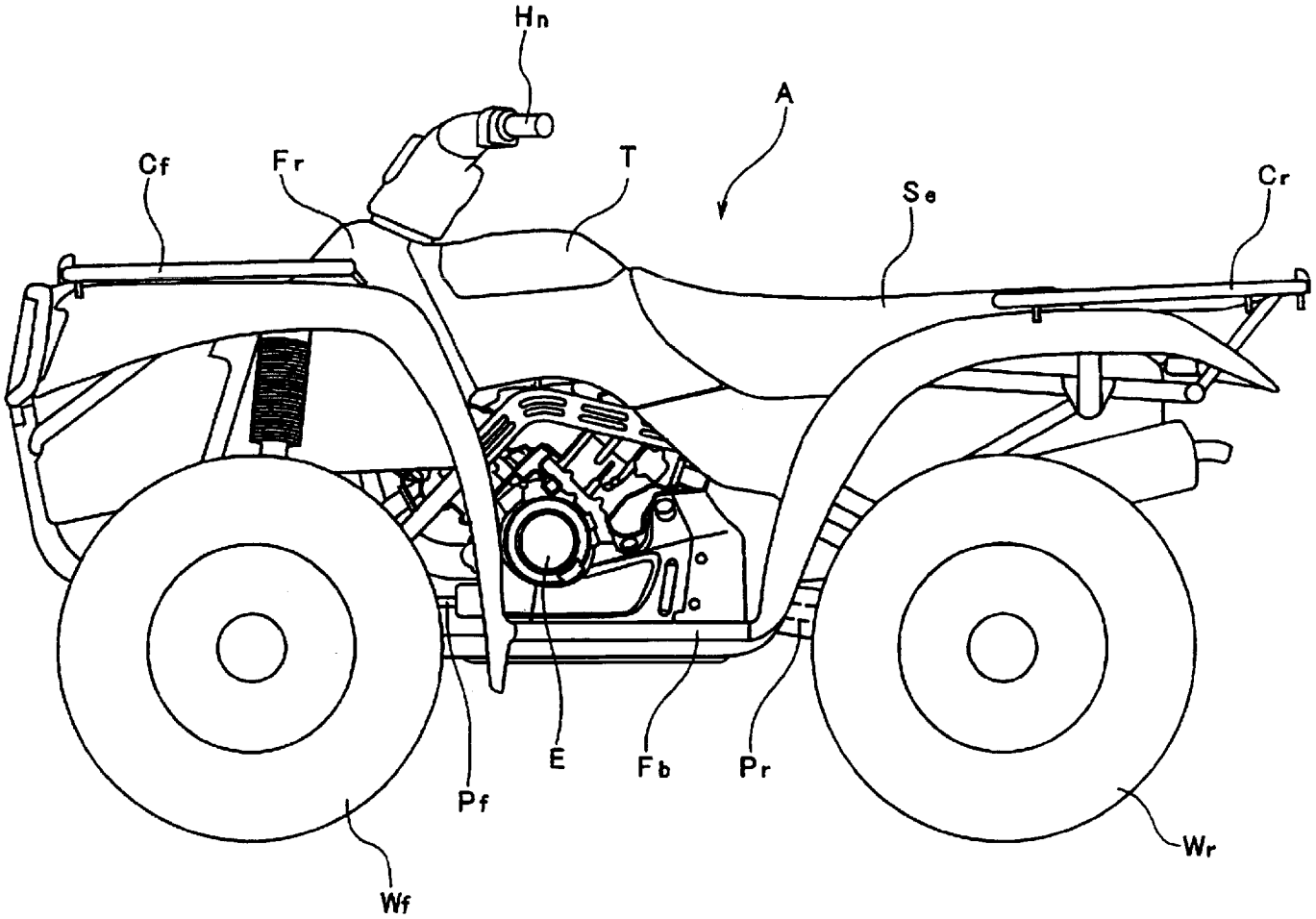
FIG. 1 is a side view showing an entire all terrain vehicle in which a SOHC-type engine is mounted, the engine employing the cam shaft positioning structure of an engine, according to an embodiment of the present invention.

FIG. 1 is a side view showing the entire all terrain vehicle in which a SOHC (single overhead cam) type engine is mounted. The SOHC-type engine employs a cam shaft positioning structure of an engine according to an embodiment of the present invention.

Referring now to FIG. 1, a straddle-type four wheeled all terrain vehicle A comprises a bar-type steering handle Hn rotatably mounted to a vehicle body frame Fr, right and left front wheels Wf, and right and left rear wheels Wr. The straddle-type four wheeled all terrain vehicle A further comprises a front carrier Cf placed forward of the handle Hn, a cover T placed rearward of the handle Hn, a straddle-type seat Se placed rearward of the cover T, a rear carrier Cr placed rearward of the seat Se, and foot boards Fb provided on both sides located forward and below of the seat Se and at positions substantially as high as axles of the front wheels Wf and the rear wheels Wr. The vehicle A is provided with a V-type two cylinder SOHC-type four-cycle engine (hereinafter simply referred to as a V-type engine) E placed below the cover T such that a lower end of the V-type engine E is substantially as high as the foot boards Fb and having a reduced engine width and a compact cylinder head portion. The two cylinders of the V-type engine E are arranged in the longitudinal direction of the vehicle so as to have an angle between them.

The V-type engine E is adapted to drive the front wheels Wf or the rear wheels Wr via a torque converter (not shown), a transmission gear unit (not shown), a front output shaft Pf or a rear output shaft Pr respectively provided substantially in the longitudinal direction, and a differential unit (not shown).

In so constituted straddle-type four wheeled all terrain vehicle A, a rider straddles a seat Se, puts the rider's feet on the foot boards Fb, and grips the handle Hn with both hands to operate the vehicle A. It is therefore preferable that the width of the engine E is small and the cylinder head portion is compact, because the rider can easily straddle the vehicle A and the degree of freedom of the position at which the engine is mounted is increased.

Subsequently, the cam shaft positioning structure employed in the SOHC-type engine will be described.

Figure 2:
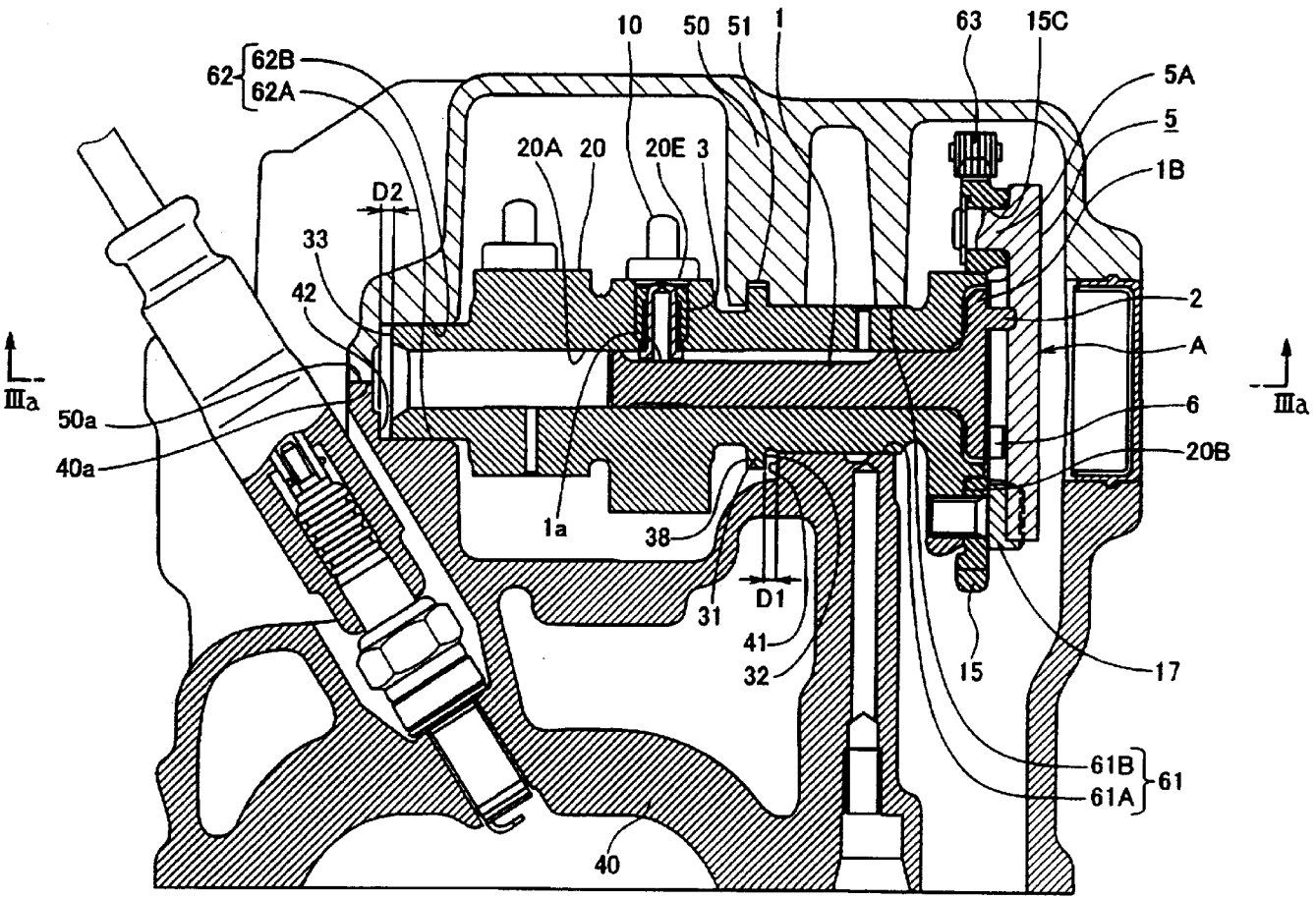
FIG. 2 is a cross-sectional elevational view showing a cylinder head portion of the SOHC-type engine employing the cam shaft positioning structure of an engine, according to the embodiment of the present invention.

FIG. 2 is a cross-sectional view showing a cylinder head portion of the SOHC-type engine which employs the cam shaft positioning structure. Referring to FIG. 2, a rocker case 50 is mounted on a cylinder head 40 and a cam shaft 20 is securely retained between the cylinder head 40 and the rocker case 50. The rocker case 50 functions as a member for positioning the cam shaft 20. In FIG. 2, the axial direction of the cam shaft 20 corresponds with the right and left direction. The cam shaft 20 is provided with a cam sprocket 15 at one end thereof. Hereinbelow, it is assumed that the side (one end side) of the cam shaft 20 on which the cam sprocket 15 is provided is a right side and the opposite side (the other end side) is a left side.

The cylinder head 40 and the rocker case 50 are in contact with each other at joint faces 40*a*, 50*a*. The joint face 40*a* is part of an upper surface of the cylinder head 40 and the joint face 50*a* is part of a lower surface of the rocker case 50.

The cylinder head 40 is provided with a right lower bearing portion 61A as one of semi-circular portions of a right bearing 61 for rotatably supporting the cam shaft 20. The rocker case 50 is provided with a right upper bearing portion 61B as the other semi-circular portion of the right bearing 61. So, by mounting the rocker case 50 on the cylinder head 40, the entire right bearing 61 is formed.

The cylinder head 40 is provided with a left lower bearing portion 62A as one of semi-circular portions of a left bearing 62. The rocker case 50 is provided with a left upper bearing portion 62B as the other semi-circular portion of the left bearing 62. So, by mounting the rocker case 50 on the cylinder head 40, the entire left bearing 62 is formed.

The cam shaft 20 is rotatably supported by means of the right and left bearings 61, 62.

The cam shaft 20 is provided with a flange portion 31 and the rocker case 50 is provided with a groove 51. The semi-circular portion of the flange portion 31 of the cam shaft 20 is accommodated in the groove 51. The width (axial dimension) of the groove 51 is slightly larger than the thickness (axial dimension) of the flange portion 31. Therefore, the flange portion 31 is substantially unmovable in the axial direction because of restriction by the groove 51. This means that the groove 51 serves to axially position the flange portion 31. In other words, the cam shaft 20 is axially positioned with respect to the cylinder head 40 by the groove 51. The axial predetermined position of thus positioned cam shaft 20 is, hereinbelow, referred to as "normal position".

The cylinder head 40 is provided with a right contact face 41. The right contact face 41 is opposed to a right end face 32 of the flange portion 31 so as to be spaced a predetermined distance D1 apart therefrom.

The cylinder head 40 is provided with a left contact face 42. The left contact face 42 is opposed to a left end face 33 of the cam shaft 20 so as to be spaced a predetermined distance D2 apart therefrom.

FIG. 2 shows the state in which the rocker case 50 is mounted on the cylinder head 40. By removing the rocker case 50 with the cam shaft 20 placed on the cylinder head 40, the cam shaft 20 becomes displaceable axially with respect to the cylinder head 40 within a predetermined range.

More specifically, the cam shaft 20 is rightwardly displaceable until the right end face 32 of the flange portion 31 makes contact with the right contact face 41 of the cylinder head 40. Also, the cam shaft 20 is leftwardly displaceable until the left end face 33 makes contact with the left contact face 42 of the cylinder head 40. Thus, in the state in which the rocker case 50 is not mounted on the cylinder head 40, the cam shaft 20 is rightwardly or leftwardly displaceable from the normal position by the distance D1 or D2, respectively.

Figure 3A:
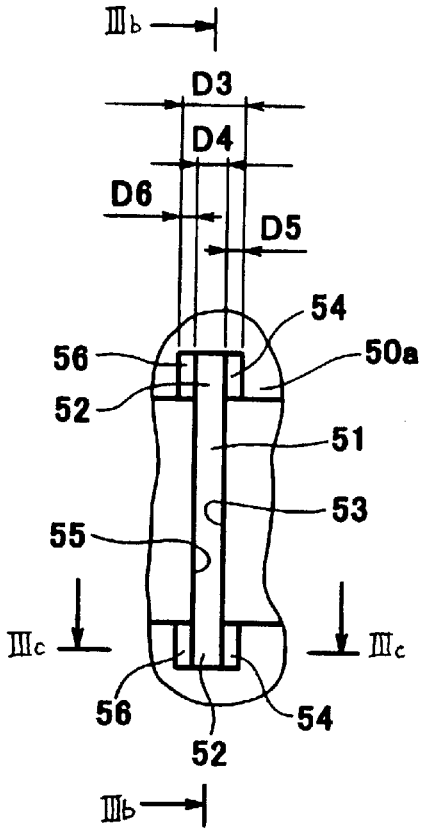
FIG. 3A is a view taken in the direction of the arrows substantially along line IIIa—IIIa of FIG. 2 and a partial view showing a cam shaft positioning portion of a rocker case except a cam shaft.
Figure 3B:
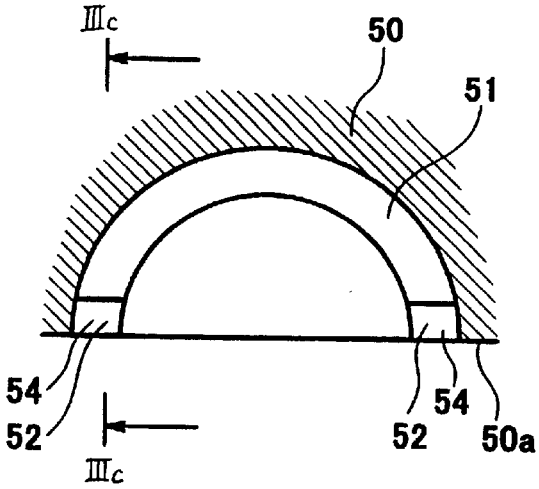
FIG. 3B is a cross-sectional view taken in the direction of the arrows substantially along line IIIb—IIIb of FIG. 3A and a cross-sectional view sectioned along a plane orthogonal to an axis of the cam shaft.
Figure 3C:
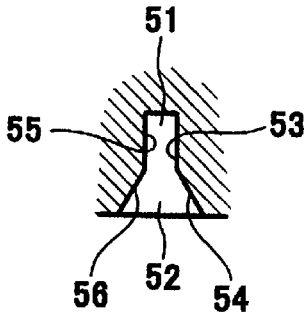
FIG. 3C is a cross-sectional view taken in the direction of arrows substantially along line IIIc—IIIc of FIG. 3A.

FIGS. 3A–3C are views showing a detailed structure of the groove 51, wherein FIG. 3A is a view showing the groove 51 seen from the direction of the joint face 50*a* (partial view taken in the direction of the arrows substantially along line IIIa—IIIa of FIG. 2), FIG. 3B is a cross-sectional view of the groove 51 and its vicinity when the portion of the rocker case 50 including the groove 51 is sectioned along the plane orthogonal to the axis of the cam shaft 20 (cross-sectional view taken in the direction of arrows substantially along line IIIb—IIIb of FIG. 3A), and FIG. 3C is a cross-sectional view taken in the direction of arrows substantially along line IIIc—IIIc of FIG. 3A. The cross section along line IIIc—IIIc of FIG. 3B is similar to the cross section of FIG. 3C.

Referring to FIGS. 3A–3C, guide portions 52 are formed at the groove 51 in the vicinity of the joint face 50*a* of the rocker case 50. More specifically, the guide portions 52 are formed at opposite end portions in the circumferential direction of the groove 51. To be more detailed, right cutout faces 54 are formed on a right end face 53 of the groove 51 in the vicinity of the joint face 50*a* so as to be inclined with respect to the right end face 53 and left cutout faces 56 are formed on a left end face 55 of the groove 51 in the vicinity of the joint face 50*a* so as to be inclined with respect to the left end face 55. The pair of these inclined faces (right and left cutout faces 54, 56) form the guide portions 52.

In this embodiment, the axial length of an entrance of the guide portion 52 is D3. Assuming that the width of the groove 51 is D4, the length from the right end face 53 of the groove 51 to the right end of the entrance of the guide portion 52 is D5, and the length from the left end face 55 of the groove 51 to the left end of the entrance of the guide portion 52 is D6, the axial length D3 of the entrance of the guide portion 52 is the sum of the lengths D4, D5, D6. The length D5 is larger than the distance D1 and the length D6 is larger than the distance D2.

The above-described cam shaft positioning structure makes it possible to easily assemble the cam shaft 20 into the engine E. The procedure for assembling the cam shaft 20 having this positioning structure into the engine E will be described later.

Subsequently, a decompression control mechanism will be described. The SOHC-type engine is provided with an automatic decompression device including a decompression control mechanism constituted as follows.

Figure 4A:
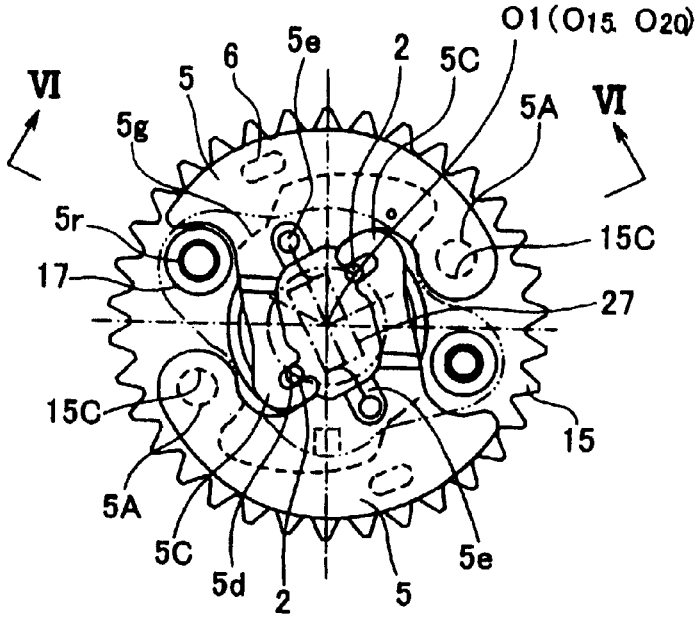
FIG. 4A is a side view of main parts of a decompression control mechanism seen from the direction of the arrows substantially along line IVa—IVa of FIG. 6.
Figure 4B:
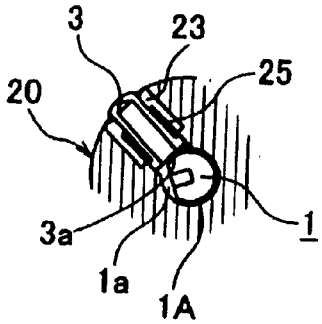
FIG. 4B is a partially enlarged view of an upper half portion of a decompression lifter portion seen from the direction of arrows substantially along line IVb—IVb of FIG. 6 when the decompression control mechanism is in the state of FIG. 4A.
Figure 5A:
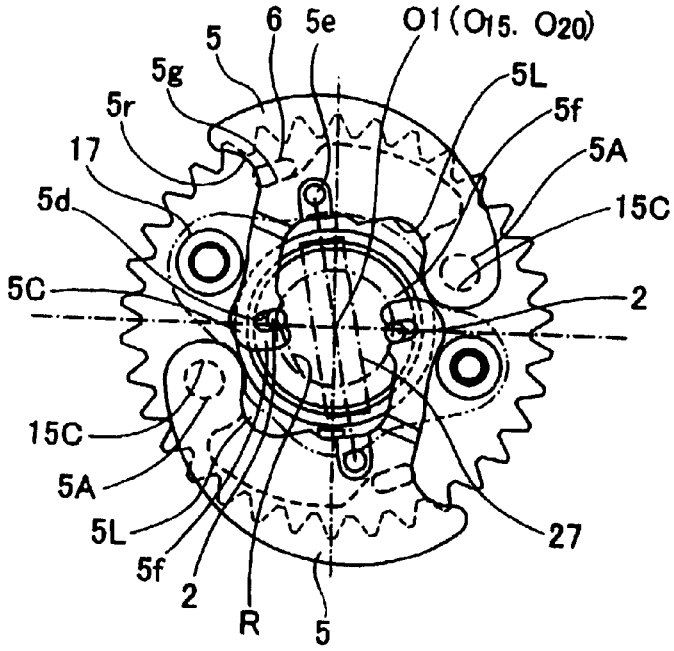
FIG. 5A is a side view of the main parts of the decompression control mechanism seen from the direction of arrows substantially along line IVa—IVa of FIG. 6.
Figure 5B:
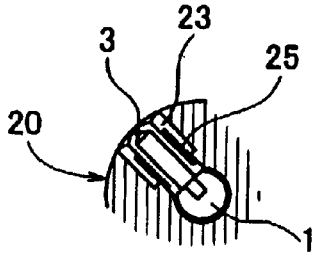
FIG. 5B is a partially enlarged view of an upper half portion of a decompression lifter seen from the direction of arrows substantially along line IVb—IVb of FIG. 6 when the decompression control mechanism is in the state of FIG. 5A.
Figure 6:
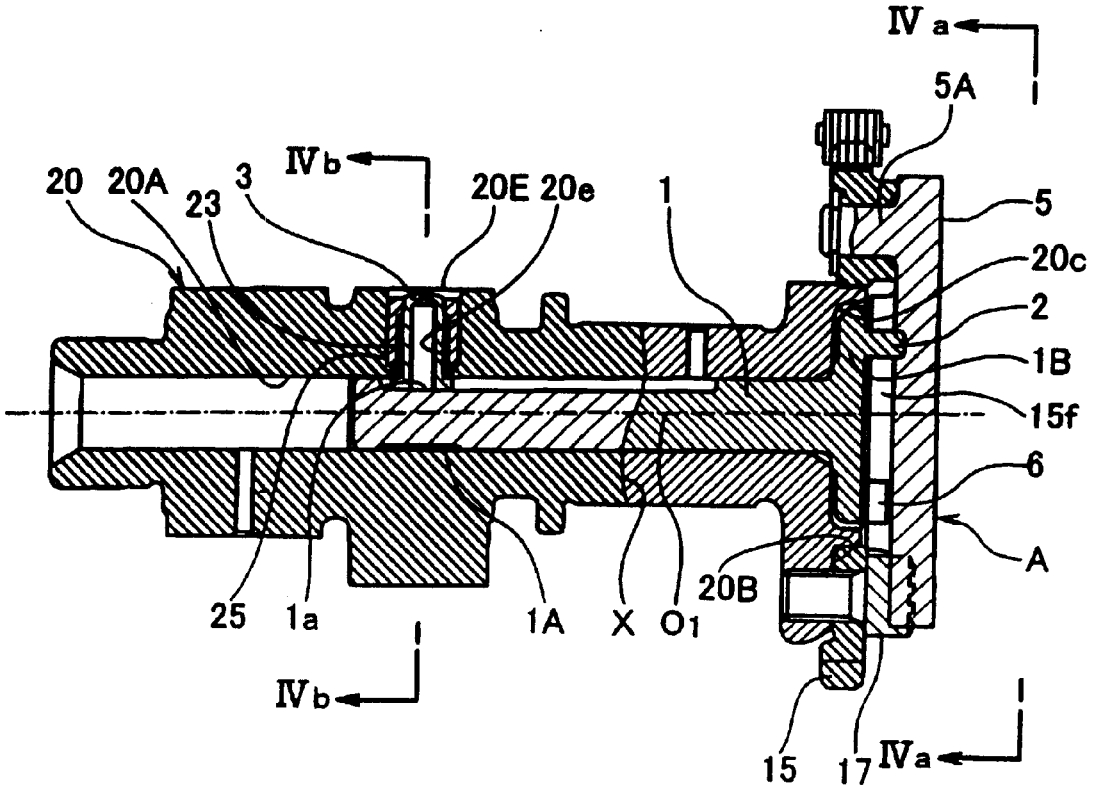
FIG. 6 is a cross-sectional view showing a constitution of an entire automatic decompression device, in which a portion on the left side from a break line X is sectioned along the longitudinal direction of the cam shaft and a portion on the right side is seen from the direction of the arrows substantially along line VI—VI of FIG. 4A.

FIGS. 4A, 4B are views showing a constitution of main parts of a decompression control mechanism in operation, which is employed in the SOHC-type engine, wherein FIG. 4A is a side view of the main parts of the decompression control mechanism seen from the direction of arrows substantially along line IVa—IVa of FIG. 6, and FIG. 4B is a partially enlarged view of an upper half portion of a decompression lifter when the decompression control mechanism is in the state of FIG. 4A. FIGS. 5A, 5B are views showing a constitution of main parts of the decompression control mechanism in non-operation, wherein FIG. 5A is a side view of the main parts of the decompression control mechanism seen from the direction of the arrows substantially along line IVa—IVa of FIG. 6, and FIG. 5B is a partially enlarged view of an upper half portion of a decompression lifter seen from the direction of arrows substantially along line IVb—IVb of FIG. 6 when the decompression control mechanism is in the state of FIG. 5A. FIG. 6 is a view showing an entire constitution of an automatic decompression device, in which a portion on the left side from a break line X is a portion sectioned along the longitudinal direction of the cam shaft and a portion on the right side from the break line X is a cross-sectional view seen from the direction of arrows substantially along line VI—VI of FIG. 4A.

Referring to FIG. 6, a penetrating hole 20A is formed in a center axis portion of the cam shaft 20. An operating shaft 1 is inserted into the penetrating hole 20A. In this embodiment, a tip end portion of the operating shaft 1 is extended to a portion of the cam shaft 20 at which an exhaust cam face 20E is formed. A flat face portion 1*a* obtained by cutting the operating shaft 1 in a crescent shape is formed at a tip end portion of the operating shaft 1. As shown in FIGS. 4B, 5B, 6, a partial circumferential face 1A including the flat face portion 1*a* is slidably in contact with a bottom face 3*a* of a decompression lifter 3, and when the flat face portion 1*a* is in contact with the bottom face 3*a* of the decompression lifter 3, a tip end portion of the decompression lifter 3 is accommodated radially inwardly of the exhaust cam face 20E (see FIGS. 5B, 6), while when a circumferential portion of the partial circumferential face 1A is in contact with the bottom face 3*a* of the decompression lifter 3, the tip end portion of the decompression lifter 3 is protruded radially outwardly from the exhaust cam face 20E (see FIG. 4B).

A cam sprocket 15 for driving the cam shaft 20 is fixed to a base end face 20B (right end face in FIGS. 6, 2) of the cam shaft 20 by means of a hexagon socket head cap screw 17. A decompression control mechanism A is provided at a base end portion of the cam shaft 20, for operating the decompression lifter 3. Hereinbelow, the decompression control mechanism A will be described in detail.

Referring to FIGS. 4A–4B through 6, a cylindrical concave portion 20*c* is formed at the base end face 20B of the cam shaft 20 around the center axis of the cam shaft 20. A flange portion 1B formed at the base end portion of the operating shaft 1 is accommodated in the concave portion 20*c*. The flange portion 1B is provided with two engagement pins 2 protruded from the flange portion 1B in the longitudinal direction of the shaft 20 with a center of rotation O1 located between these pins 2.

Two penetrating holes 15C are formed in outer peripheral portions of the cam sprocket 15 with the center of rotation O15 situated between these holes 15C.

Pivot portions 5A of weight members 5 are rotatably mounted to the penetrating holes 15C. The weight members 5 are swingable within a predetermined angle (swing area) around the pivot portions 5A. Specifically, in this embodiment, the weight members 5 are capable of swinging within a predetermined angle (swing area) from the state in which the members 5 are located radially inwardly as shown in FIG. 4A to the state in which the members 5 are located radially outwardly as shown in FIG. 5A.

As shown in FIGS. 4A, 5A, each of the weight members 5 has an outer periphery having a curvature radius slightly smaller than that of an outer periphery of the cam sprocket 15. Tip end portions 5C of the weight members 5 are located on the opposite side of the pivot portions 5A with respect to a center axis O20 (identical to the center of rotation O15) of the cam shaft 20. Engagement grooves 5*d* which engage with the engagement pins 2 are formed at the tip end portions 5C. The engagement grooves 5*d* are formed in the direction orthogonal to a swing track R of the tip end portions 5C when the weight members 5 swing around the pivot portions 5A. This swing causes the engagement pins 2 to swing around the center of rotation (identical to the center axis O20 of the cam shaft 20) of the flange portion 1B.

The weight members 5 are swingably provided on side faces of the cam sprocket 15 so as to be symmetric with respect to the center axis O20 of the cam shaft 20. Engagement holes 5*e* are respectively formed in the vicinity of inner peripheries of central portions of the weight members 5. A coil spring 27 is provided between the engagement holes 5*e* to bias the weight members 5 to be close to each other. When the cam sprocket 15 is in the non-rotating condition, the weigh members 5 are held as shown in FIG. 4A.

As shown in FIGS. 4A, 5A, 6, restricting protrusions 6 are formed at end faces of the cam sprocket 15 on which the weight members 5 are provided, and the weight members 5 are provided with contact portions 5*g* which are formed at faces of the weight members 5 on which the cam sprocket 15 is provided and configured to make contact with the protrusions 6. When the weight member 5 swings radially outwardly, the contact portion 5*g* makes contact with the protrusion 6, thereby restricting further outward swing of the weight member 5. A concave portion 5L, conforming in shape to a head portion 5*f* of the tip end portion 5C of one of the weight members 5, is formed in the other weight member 5 so as to be slightly apart from the pivot portion 5A thereof. This concave portion 5L functions as a restricting portion. Specifically, when one of the weight members 5 swings radially inwardly, the concave portion 5L of the other weight member 5 is brought into contact with the hook-shaped head portion 5*f* (side view) of the tip end portion 5C of the one weight member 5, thereby restricting further inward swing of the weight member 5.

The restricting portion comprised of the concave portion 5L may be replaced by the head potion of the bolt 17. In that case, when the weight member 5 swings radially inwardly, a recessed portion 5*r* of the weight member 5 seen in a side view is brought into contact with the head portion of the bolt 17, thereby restricting further inward swing of the weight member 5.

As shown in FIGS. 4B, 5B, 6, the decompression lifter 3 has a partially spherical head portion. The decompression lifter 3 is accommodated in a sleeve 23 fittingly mounted to an accommodating hole 20*e* formed in the cam face 20E so as to be able to be protruded outwardly from the cam face 20E or is accommodated radially inwardly by the force of the coil spring 25, that is, a top portion of the head portion of the decompression lifter 3 is as high as the cam face 20E or is retracted toward the center axis of the shaft 20.

The automatic decompression device so constituted functions as follows. Prior to start of the engine, as shown in FIGS. 4A, 4B, the two weight members 5 are biased by the coil spring 27 so as to be close to each other. In this state, the operating shaft 1 engaged with the weight members 5 by means of the engagement pins 2, is in the cam shaft 20, as shown in FIG. 4B. Specifically, the circumferential portion of the partial circumferential face 1A of the operating shaft 1 is slidably in contact with the bottom face 3*a* of the decompression lifter 3. Therefore, the decompression lifter 3 is protruded radially outwardly from the cam face 20A and a contact portion of the rocker arm 10 for exhaust (see FIG. 2) is lifted up. At this time, an exhaust valve (not shown) of the engine is placed at an open position.

In this state, when the engine is started by an electric starter or a hand-operated recoil starter, a pressure in the cylinder is reduced because the interior of the cylinder is opened in atmosphere, which enables starting at small rotational torque.

When the engine is started by the electric starter or the hand-operated recoil starter and thereby the engine speed exceeds a predetermined speed, for example, idling engine speed, the weight member 5 swings around the pivot portion 5A radially outwardly as shown in FIG. 5A, because the centrifugal force exerted on the weight member 5 exceeds the force from the coil spring 27. So, the operating shaft 1 engaged with the weight members 5 by means of the engagement pins 2 is rotated in the cam shaft 20 and, as shown in FIG. 5B, the bottom face 3*a* of the decompression lifter 3 makes contact with the flat face portion 1*a* of the partial circumferential face 1A.

As a consequence, since the head portion of the decompression lifter 3 is accommodated radially inwardly of the cam face 20A, the rocker arm 10 for exhaust is in contact with the cam face 20A. The exhaust valve (not shown) of the engine is brought to a closed position and the cylinder is hermetically sealed. At this stage, the engine is in a normal operating condition. In other words, the engine is released from a decompressed condition.

In this constitution, even if a rotational angle of the engagement pins 2 with respect to the center of rotation is made sufficiently large as necessary, a swing angle of the weight members 5 is small. In that case, therefore, as shown in FIG. 5A, the weight members 5 are slightly protruded from the outer peripheries of the cam sprocket 15. That is, a diametric dimension of the decompression control mechanism A can be reduced. As shown in FIG. 6, the decompression control mechanism A is constituted such that the weight member 5 and the cam sprocket 15 are placed close to each other in the thickness direction of the cam sprocket 15, and all the components are placed between them. Therefore, the decompression control mechanism A can also be made compact in the thickness direction of the cam sprocket 15. In particular, because part of the side face of the weight member 5 on which the cam sprocket 15 is provided is cut to form a portion 15*f* in which part of the protrusion 6 is accommodated, and the contact portion 5*g* which makes contact with the protrusion 6 is formed in the portion 15*f*, the mechanism A has a compact structure.

In the automatic decompression device according to the present invention that functions as described above, since the decompression control mechanism is compactly constituted as shown in FIG. 2, the cylinder head portion of the engine can be made compact. Because of the compact head portion of the engine, this engine is well suitable as the engine mounted in the straddle-type four wheeled all terrain vehicle and the degree of freedom at which the engine is mounted therein is increased. In addition, the cost is low, since the number of parts and the man-hour for assembly can be reduced as compared to the conventional decompression device.

Figure 7A:
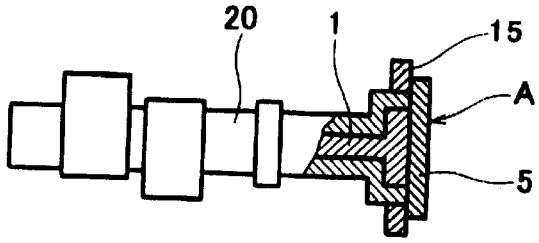
FIGS. 7A–7D are views showing a procedure for assembling the cam shaft into an engine.

Subsequently, the procedure for assembling the cam shaft 20 into the engine E will be described with reference to FIGS. 7A–7D. In FIGS. 7A,–7D, the constitution of the cylinder head 40, the cam shaft 20, the rocker case 50, and the decompression control mechanism A and the like are simplified.

First of all, as shown in FIG. 7A, before the cam shaft 20 is placed on the cylinder head 40, the operating shaft 1 and the decompression lifter 3 are inserted into the cam shaft 20 and the cam sprocket 15 is secured to the cam shaft 20 by means of the bolt 17. Further, the weight members 5 and the coil spring 27 are mounted to the cam shaft 20 and the operating shaft 1. In brief, the cam sprocket 15 and the decompression control mechanism A are mounted to the cam shaft 20.

Figure 7B:
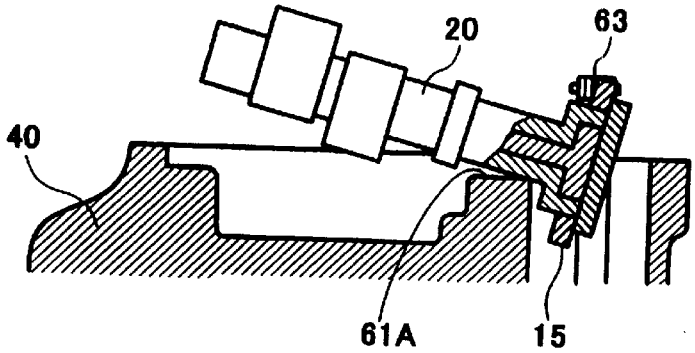

Then, as shown in FIG. 7B, the cam shaft 20 with the cam sprocket 15 and the decompression control mechanism A is placed on the cylinder head 40 and the chain 63 is put around the cam sprocket 15. At this time, as shown in FIG. 7B, by inclining the cam shaft 20 on the right lower bearing portion 61A of the cylinder head 40 as the center of support, the chain 63 is easily put around the cam sprocket 15. This is because the chain 63 can be put around the cam sprocket 15 in a loose condition.

Figure 7C:
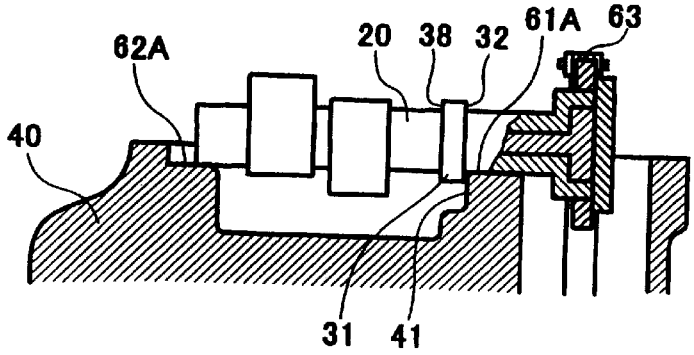
Figure 7D:
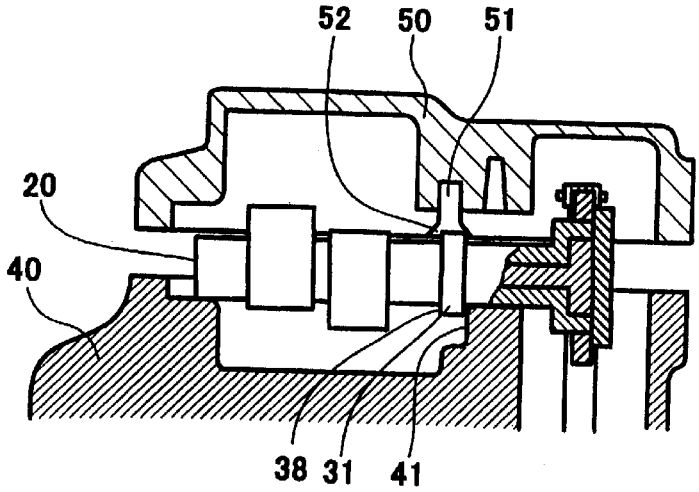
Figure 8:
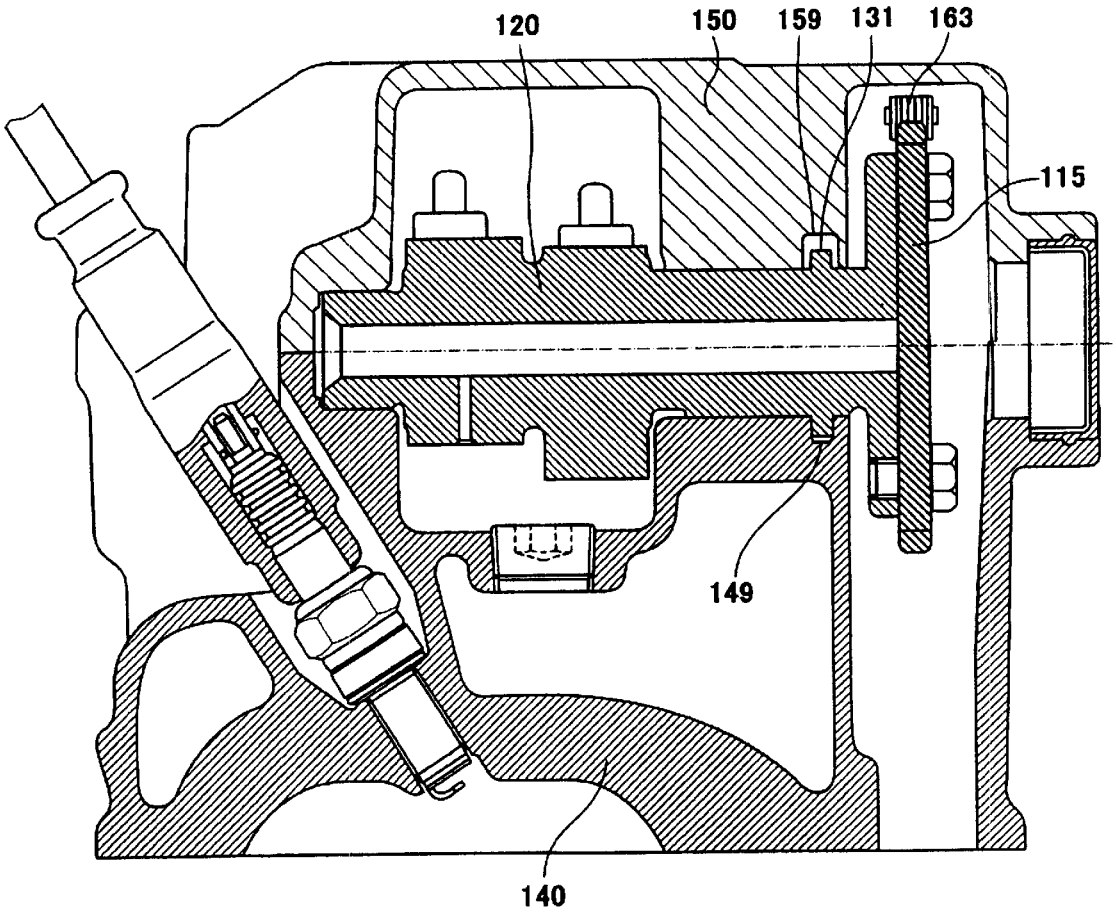
FIG. 8 is a view showing the conventional cam shaft positioning structure and a longitudinal sectional view of a cylinder head and a rocker case of an engine.

FIG. 7C shows the state in which the cam shaft 20 is placed on the right lower bearing portion 61A and the left lower bearing portion 62A of the cylinder head 40 after the chain 63 is put around the cam sprocket 15. In the state of FIG. 7C, since the rocker case 50 is not mounted on the cylinder head 40 yet, the cam shaft 20 is axially displaceable from the normal position to some degrees. In the state of FIG. 7C, the right end face 32 of the flange portion 31 is in contact with the right contact face 41 of the cylinder head 40.

Then, as shown in FIG. 7D, the rocker case 50 is placed on the cylinder head 40. The groove 51 of the rocker case 50 is provided with the guide portions 52. As mentioned previously, the length D5 is larger than the distance D1. This means that the right end face 32 of the flange portion 31 is located at the left of the right end position of the entrance of the guide portions 52 even when the cam shaft 20 is axially displaced to the rightmost side. Therefore, even when the cam shaft 20 is displaced axially rightwardly from the normal position and the right end face 32 of the flange portion 31 is in contact with the right contact face 41 of the cylinder head 40, the flange portion 31 enters the entrance of the guide portions 52 and is guided to the groove 51 by the guide portions 52, upon the rocker case 50 being placed on the cylinder head 40. In other words, the axial displacement of the cam shaft 20 is eliminated and the cam shaft 20 is guided to the normal position.

Even when the cam shaft 20 is displaced to the opposite direction of the state of FIG. 7D, i.e., axially to the leftmost side, the left end face 38 of the flange portion 31 is located at the right of the left end position of the entrance of the guide portion 52. This is because the length D6 is larger than the distance D2. Therefore, the flange portion 31 enters the entrance of the guide portions 52 and is guided by the guide portions 52 so as to be inserted into the groove 51.

Lastly, as shown in FIG. 2, the axial position of the flange portion 31 is restricted by the groove 51, thereby allowing the cam shaft 20 to be axially positioned with respect to the cylinder head 40 so as to be placed at the normal position.

As should be understood, since the structure for axially positioning the cam shaft 20 to be placed at the normal position is not provided on the side of the cylinder head 40, the cam shaft 20 placed on the cylinder head 40 is axially displaceable. Therefore, as shown in FIG. 7B, the cam shaft 20 provided with the cam sprocket 15 and the decompression control mechanism A can be placed on the cylinder head 40 in an inclined condition and the chain 63 can be put around the cam sprocket 15 in a loose condition. Thus, the cam sprocket 15 and the decompression control mechanism A can be mounted to the cam shaft 20 before the cam shaft 20 is placed on the cylinder head 40. This greatly facilitates the assembly of the cam shaft 20 into the engine E.

In addition, by providing the guide portions 52 in the groove 51, the alignment of the groove 51 and the flange portion 31 can be easily made.

In the above-described embodiment, as the cam shaft position restricting means, the cylinder head is provided with the contact faces 41, 42 at the right and left portions, which make contact with the cam shaft 20 when the cam shaft 20 is axially displaced. The restricting means is capable of restricting the axial displacement of the cam shaft 20. By placing the cam shaft 20 in this restricted range, the cam shaft is placed at substantially proper axial position of the cylinder head 40. Alternatively, only one of the right and left contact faces 41, 42 may be provided. Moreover, the cam shaft may be axially guided into the predetermined range by any other means different from the contact faces, including marking, jig, etc.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A cam shaft positioning structure of an engine comprising: a cylinder head provided with one part of a bearing; a rocker case provided with the other part of the bearing; and a cam shaft rotatably supported by the bearing formed by mounting the rocker case on the cylinder head, and being applied to a single over head cam type engine, wherein the cam shaft is provided with a flange portion, the rocker case is provided with a groove for accommodating the flange portion, and wherein in a first state in which the rocker case is mounted on the cylinder head and the cam shaft is securely retained between the cylinder head and the rocker case, the groove is adapted to restrict axial displacement of the flange portion to allow the cam shaft to be axially positioned with respect to the cylinder head so as to be placed at a normal position, and in a second state in which the cam shaft is placed on the cylinder head and the rocker case is not mounted on the cylinder head, the cam shaft is able to be axially displaceable with respect to the cylinder head from the normal position.

2. The cam shaft positioning structure of an engine according to claim 1, wherein a guide portion for guiding the flange portion into the groove is formed by cutting out the rocker case at both end portions in a circumferential direction of the groove.

3. The cam shaft positioning structure of an engine according to claim 2, comprising restricting means for restricting axial displacement of the cam shaft with respect to the cylinder head from the normal position so as to be within a predetermined range in the second state, wherein in the second state, when the cam shaft is axially displaced most greatly to one side of the cylinder head, a position of one end face of the flange which is close to one side of the cylinder head is closer to the other side of the cylinder head than a first axial position, the first axial position corresponds to one end position of an entrance of the guide portion which is close to the one side of the cylinder head in the first state, in the second state, when the cam shaft is axially displaced most greatly to the other side of the cylinder head, a position of the other end face of the flange is closer to one side of the cylinder head than a second axial position, and the second axial position corresponds to the other end position of an entrance of the guide portion in the first state.

* * * * *